United States Patent [19]

Pappas

[11] 4,391,721

[45] Jul. 5, 1983

[54] DISPERSANT VISCOSITY INDEX IMPROVER COMPRISING REACTION PRODUCT OF A STYRENE-MALEIC ANHYDRIDE COPOLYMER, AN ALIPHATIC ALCOHOL AND A TERTIARY AMINO ALCOHOL

[75] Inventor: Peter G. Pappas, Downers Grove, Ill.

[73] Assignee: Standard Oil Company (Indiana), Chicago, Ill.

[21] Appl. No.: 247,600

[22] Filed: Mar. 25, 1981

[51] Int. Cl.[3] ..... C10M 1/32

[52] U.S. Cl. ..... 252/51.5 A; 525/380; 525/375; 525/329.5; 44/62; 44/63; 44/71; 44/72

[58] Field of Search ..... 252/51.5 A; 44/62, 71, 44/72, 63; 525/380, 329.5, 375

[56] References Cited

U.S. PATENT DOCUMENTS 3,520,852 7/1970 Pratt et al. ..... 525/380

*Primary Examiner*—Charles F. Warren
*Assistant Examiner*—Y. Harris-Smith
*Attorney, Agent, or Firm*—James L. Wilson; William T. McClain; William H. Magidson

[57] ABSTRACT

Dispersant viscosity index improvers comprise the reaction product of an aliphatic alcohol or mixtures thereof, a tertiary amino alcohol and a styrene maleic anhydride copolymer.

12 Claims, No Drawings

DISPERSANT VISCOSITY INDEX IMPROVER COMPRISING REACTION PRODUCT OF A STYRENE-MALEIC ANHYDRIDE COPOLYMER, AN ALIPHATIC ALCOHOL AND A TERTIARY AMINO ALCOHOL

This invention concerns novel multifunctional gasoline and lubricant additives. More particularly, this invention concerns novel nitrogen-containing esters of a styrene-maleic anhydride copolymer and the use of such compositions in gasolines and lubricants as detergents and dispersants.

It is well known to combine in polymeric additive compositions, dispersancy and viscosity index improvement. Dispersancy is the ability of an additive composition in a lubricant to suspend deposit-forming impurities which can be derived from many sources, including ingested dirt and the incomplete combustion by-products of fuels and lubricants. Viscosity index improvement is the ability of polymeric additives to provide to lubricants, at both low and high temperatures, substantial viscosity, sufficient to maintain lubricating films on the surfaces of moving parts in an engine. A number of polymeric amide type dispersant viscosity index improving additives have been disclosed in U.S. Pat. Nos. 2,615,845, 3,329,658, 3,432,479, 3,471,458, 3,637,610, 3,933,761, 3,959,159, and 3,956,149. Each discloses certain polymeric compositions prepared by reacting a maleic anhydride alpha-olefin copolymer with aliphatic alcohols and primary or secondary amines, having at least one N—H group, to form a nitrogen containing amide-type polymeric additive composition. The nitrogen containing functions taught in these patents are derived from amino compounds that form amide or imide bonds through primary or secondary amino groups. The failure of the art to disclose the use of tertiary amino compounds is not surprising since a tertiary amine cannot form amide or imide bonds. We believe that the use of amine compounds having free primary or secondary amino groups can cause the additive compositions to crosslink and thicken in use. This thickening is a substantial problem arising with the use of polymeric dispersants.

The primary object of the invention is to provide a highly effective dispersant viscosity index improving additive. Another object of this invention is to reduce the crosslinking tendency of nitrogen containing polymeric dispersants. A further object of the invention is to provide a highly effective method for the preparation of nitrogen containing esters of a styrene-maleic anhydride copolymer.

We have discovered that the objects of the invention can be attained with highly effective dispersant viscosity improving additives which comprise the reaction product of a styrene-maleic anhydride copolymer with a $C_6$ or greater primary, secondary or tertiary aliphatic alcohol, or mixture of such alcohols, and a tertiary amino alcohol.

The carboxy containing copolymers of this invention are formed by polymerizing substantially equimolar proportions of maleic anhydride and styrene. These substantially amorphous copolymers commonly have a molecular weight in the range of about 500 to 150,000 and are commonly available or prepared by well-known polymerization techniques.

Catalysts that can be used in the polymerization of the monomers include the free radical generating catalyst such as benzoyl peroxide, tertiarybutyl hydroperoxide, ditertiary butylperoxide, cumene peroxide, sunlight, ultraviolet light, etc. Peroxide catalysts are generally preferred for reasons of high catalytic activity and ease of use. The polymers can be prepared in a range of molecular weights. However, high molecular weights are desired since the polymer molecular weight can commonly be easily reduced through mechanical or chemical degradation. High molecular weight polymers can be derived by charging the styrene and maleic anhydride monomers with a diluent and catalyst to an appropriate reaction vessel which can be heated to approximately 40°–200° C. for a period of a few minutes up to 24 hours, depending on concentration of monomer, catalyst, impurity of starting materials, and diluent. The polymerization is allowed to proceed until complete. In solution polymerization the completion of the reaction can be noted by monitoring viscosity of the solution. As the viscosity ceases to increase the polymerization reaction can be considered complete. In slurry polymerization, the completion of the reaction can be monitored by comparing the viscosity of the reacting mixture to standard slurry compositions.

The dispersancy or detergency of the additives of this invention is derived from the presence of the tertiary amino groups in an ester function which arise from the reaction of a tertiary amino alcohol with a portion of the polymer anhydride groups. It is important that the nitrogen atom of the tertiary amino alkanol be fully substituted such that it cannot react to form an amide or imide bond with a carboxyl group or any other reactive groups present in the reaction mixture or subsequently encountered in lubricating oil compositions. The presence of amino compound having a —N—H group can result in harmful viscosity increase from cross-linking of dispersant molecules.

Certain of the tertiary amino alcohol compounds correspond to compounds with the following general formula:

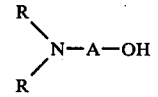

wherein A is an alkylene group having from about 2 to about 10 carbon atoms, and each R is independently selected from the group of primary, secondary or tertiary alkyl groups having 1 to 20 carbon atoms including methyl, ethyl, propyl, isopropyl, n-butyl, isobutyl, t-butyl, pentyl, hexyl, cyclohexyl, octyl, isodecyl, octadecyl, and n-eicosyl. Specific examples of the dialkyl amino alcohol include 2-dimethylaminodecanol, 2,2-methyl isopropyl amino ethanol, 2-dimethyl amino ethanol, 2-dibutylaminoethanol, 2-diisopropylaminoethanol, 2-diisodecylaminopropanol, 2-dibutylaminopentanol, 2-diamylaminopropanol, 2-dioctadecylaminodecanol, etc.

Certain other tertiary amino alcohol comprise hydroxy alkyl heterocyclic tertiary amine compounds which include compounds having a tertiary nitrogen atom included in a heterocyclic ring wherein the nitrogen atom has a hydroxy alkyl substituent group. The heterocyclic ring can contain 2–12 carbon atoms and can contain other heterocyclic atoms for example sulfur or oxygen. Specific examples of these heterocyclic hydroxyalkyl tertiary amine compounds include 1(2-hydroxyethyl)aziridine, 1(2-hydroxypropyl)aziridine, 1(2-hydroxyethyl)oxaziridine, 1,2(2-dihydroxypropyl)-pyrolidine, 1,4(2-hydroxyethyl)piperazine, 1(2-hydroxyethyl)morpholine, 1(2-hydroxyethyl)thiamorpholine, etc.

The presence of the aliphatic ester groups in the dispersant Viscosity Index Improver molecule provides sufficient solubility in lubricating oil solutions to the nitrogen containing styrene-maleic anhydride ester composition. Styrene-maleic anhydride copolymers are substantially amorphous solids which are relatively insoluble in hydrocarbons such as lubricating oils. The styrene-maleic anhydride based additives of this invention must contain, in ester form, a solubility providing amount of a $C_6$ or greater aliphatic alcohol, preferably a $C_{6-20}$ alcohol or mixtures thereof, more preferably a $C_{8-18}$ alcohol or mixtures thereof. Alcohols having less than about six carbon atoms commonly cannot provide sufficient solubility to the polymeric additives in lubricating oil to insure that the additives will remain in solution to provide dispersancy and viscosity index improvement.

Alcohol compounds which can be reacted with the carboxyl groups to form ester functions include $C_6$ and greater primary, secondary, and tertiary alcohols including hexanol, isohexanol, 2-ethylhexanol, t-octanol, isooctanol, decanol octadecanol (lauryl alcohol), tetradecyl alcohol, isooctadecanol, eicosanol, etc. These alcohols are well known and commonly made by a variety of processes including the "oxo" alcohol process.

In somewhat greater detail, the novel lubricating oil additives of this invention can be prepared by first copolymerizing styrene and maleic anhydride, reacting the copolymer with a $C_6$ or greater aliphatic alcohol or mixture of aliphatic alcohols until the copolymer is substantially completely esterified and then transesterifying with a tertiary amino alcohol. By transesterifying I mean displacing the aliphatic alcohol from a fraction of the ester groups and replacing them in the ester with a tertiary amino alcohol.

The dispersant additives of this invention can be prepared only with difficulty if the tertiary amino alcohol is reacted with the styrene-maleic anhydride copolymer before the copolymer carboxyl groups are substantially esterified. In the situation where a tertiary amino group present in an ester group adjacent to carboxyl, an internal polar amine salt can form. The amine salt containing polymer can form a substantially hydrocarbon insoluble gell which can be insoluble and useless in lubricants.

A preferred method of preparing the additives of the invention comprises reacting the copolymer with aliphatic alcohols or mixtures of alcohols to substantially esterify, the polymer. The alcohols or mixture thereof can be removed and the ester-containing polymer can be transesterified, optionally with a basic or acidic catalyst, with the tertiary amino alcohol. In this way, a portion of the aliphatic alcohol ester groups contain a dispersancy providing amount of a tertiary amino alcohol and another portion contain the solubility providing ester groups. One variation of this technique involves initiating esterification with the aliphatic alcohol. At the time such esterification is substantially complete, the tertiary amino alcohol is introduced into the reaction to achieve a mixed nitrogen-containing esterified copolymer. In either event, a two-step esterification process whereby the carboxy-containing copolymer is first esterified with the aliphatic alcohol and secondly with the tertiary amino alcohol is used to achieve the final desired degree of dispersancy and hydrocarbon solubility.

The styrene-maleic-anhydride polymers can be contacted with about 2 to 9 equivalents of alcohol per equivalent of maleic anhydride in the polymer or 1.0 to 4.5 equivalents of alcohol per equivalent of carboxyl group in the polymer. Preferably to conserve alcohol but to promote complete reaction about 2.1 to 3.0 equivalents of alcohol per equivalent of maleic anhydride can be used. The alcohol or mixtures thereof are contacted at a temperature about 100° to 450° F., preferably to prevent depolymerization or other decomposition, the reaction can be performed at about 150° to 350° F. Depending on purity, concentration, temperature and other reaction conditions, the esterification can take from about 30 minutes to 12 hours. Common esterification catalysts can be used to promote the esterification reaction. Examples of common catalysts include sulfuric acid, sulfonic acid, acidic ion exchange resins, boron trifluoride, etc. The catalyst can be added to the mixture neat, in solution or in combination with any convenient reactant. These esterification conditions are well known. The esterified polymer material can conveniently be stripped of volatile materials and filtered of undesirable solids at this point.

The nitrogen containing tertiary amino alcohol can be reacted with the polymer ester composition in order to transesterify the polymer, replacing aliphatic ester groups with tertiary amino ester groups. Sufficient tertiary amino alcohol can be contacted with the esterified polymer to provide the dispersancy needed to suspend deposit-precursors in the oil. Commonly, about 0.1 to 5 equivalents of tertiary amino alkanol and preferably, to reduce alkanol consumption, 0.2 to 2.0 equivalents of tertiary amino alkanol can be reacted per equivalent of maleic anhydride in the polymer. Since high quality dispersants commonly contain about 0.05–1% nitrogen in the form of a nitrogen containing ester group the amount of tertiary amino alcohol used can be varied to result in the optimum nitrogen content. The tertiary amino alcohol can be contacted with the esterified polymer at 100° F.–450° F., preferably 250°–375° F. to promote the reaction without substantial degradation. With a reactive low molecular weight tertiary amino alcohol, the transesterification reaction can occur rapidly. However, the rate is dependent on temperature and the concentration and purity of reactants. Commonly, the transesterification reaction is complete in 0.1 to 12 hours.

Common acidic and basic catalysts can be used to transesterify the polymer with the tertiary amino alkanol. Examples of useful catalysts include sodium metal, sodium methylate, sodium salt of a disubstituted amino alcohol, aluminum chloride, phosphoric acid, sulfonic acid, acidic and basic ion exchange resins, etc.

The fuels and oleaginous materials or oils to which the additives may be added, e.g., lubricants, include the animal and vegetable oils, e.g., castor oil, lard oil, etc., as well as the solvent-refined or acid-refined mineral lubricating oils of the paraffinic, naphthenic, or mixed paraffinic-naphthenic types. Oils of lubricating viscosity derived from coal or shale are useful base oils. The synthetic lubricating oils include the hydrocarbon oils and halo-substituted hydrocarbon oils such as polymerized and interpolymerized olefins (e.g., polybutylenes, propyleneisobutylene copolymers, chlorinated polybutylenes, etc.); alkyl benzenes (e.g., dodecylbenzene, tetradecyl benzene, dinonylbenzene, di-(2-ethylhexyl)- benzene, etc.); polyphenyls (e.g., biphenyls, terphenyls, etc.) and the like. The alkylene oxide polymers and interpolymers and derivatives thereof where the terminal hydroxyl groups have been modified by esterification, etherification, etc., comprise another class of known synthetic lubricating oils. These are exemplified by the oils prepared by polymerization of ethylene oxide, propylene oxide, the alkyl and aryl ethers of these polyoxyalkylene polymers, e.g., methylpolyisopropylene glycol ether having an average molecular weight of 1000, diphenyl ether of polyethylene glycol having a molecular weight of 500 to 1000, diethyl ether of polypropylene glycol having a molecular weight of 1000 to 1500, etc., or mono- and polycarboxylic esters thereof, for example, the acetic acid esters, mixed $C_3$–$C_8$ fatty acid esters or the $C_{13}$Oxo acid diester of tetraethylene glycol, etc.

Other synthetic lubricating oils comprising the esters of dicarboxylic acids (e.g., phthalic acid, succinic acid, maleic acid, azelaic acid, suberic acid, sebacic acid, fumaric acid, adipic acid, linoleic acid dimer, etc.) with a variety of alcohols (e.g., butyl alcohol, hexyl alcohol, dodecyl alcohol, 2-ethylhexyl alcohol, pentaerythritol, etc.) can be used. Specific examples of these esters include dibutyl adipate, di(2-ethylhexyl)-sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of 2-ethyl-hexanoic acid and the like.

Silicone-based oils such as the polyalkyl-, polyaryl-polyalkoxy-, or polyaryloxy-siloxane oils and silicate oils comprise another class of synthetic lubricants (e.g., tetraethyl-silicate, tetraisopropyl-silicate, tetra-(2-ethylhexyl)-silicate, tetra-(4-methyl-2-tetraethyl)silicate, tetra-(p-tert-butylphenyl)-silicate, hexyl-(4-methyl-2-pentoxy)-disiloxane, poly(methyl)disiloxanes, poly(methylphenyl)-siloxanes, etc.). Other synthetic lubricants include the liquid esters of phosphorus-containing acids (e.g., tricresyl phosphate, trioctyl phosphate, diethyl ester of decane phosphonic acid, etc.), polymeric tetrahydrofurans and the like.

The above-described fuels or lubricants can contain 0.001 to 25 wt%, preferably 0.1 to 10 wt% of the additives of this invention.

In addition to the nitrogen-containing esters of this invention, it is obvious that other known additives may be used in combination with the esters in fuels or lubricants, etc. These additives may include, for example, detergents of the ash-containing type, dispersants of the ashless-type, other viscosity-index improving agents, pour point depressing agents, antifoam agents, extreme-pressure agents, rust-inhibiting agents, oxidation and corrosion inhibiting agents, and various mixtures of these materials in various proportions. More particularly, the ash-containing detergents may be illustrated by the oil soluble neutral and basic salts of the alkali or alkaline earth metals of the sulfonic acids, carboxylic acids, or the organic phosphorus acids. An additive may be prepared, for example, by the reaction of an olefin polymer, e.g., polyisobutene, having a molecular weight of about 2000 with a phosphorizing agent including, for example, phosphorus trichloride, phosphorus heptasulfide, phosphorus pentasulfide, phosphorus trichloride and sulfur, white phosphorus, and a sulfur halide or phosphorothioic chloride. The compositions most commonly used, however, are the salts of sodium, potassium, lithium, calcium, magnesium, strontium, barium and various mixtures thereof.

The following examples are illustrative of the preparation of the nitrogen-containing mixed copolymer esters of the present invention.

EXAMPLE I

Styrene-Maleic Anhydride Polymerization

In a three-neck flask equipped with a stirrer, heater, nitrogen atmosphere and dropping funnel were mixed 1,600 milliliters of benzene, and 98 grams (1.0 mole) of maleic anhydride. The mixture was stirred and heated to a temperature of 165° F. (74° C.) under a nitrogen atmosphere for about 15 minutes. To the stirred and heated mixture maintained at 165° F. was added 1.0 grams (0.004 moles) benzoyl peroxide and 34.63 grams (0.33 moles) of styrene. After this addition an additional 70 grams (0.67 mole) of styrene were added dropwise to the solution from a dropping funnel over a one-hour period. The reaction mixture was maintained at 165° F. (74° C.) for about 5 hours. During this time a slurry of copolymer in benzene was formed.

Esterification

To the styrene-maleic anhydride copolymer slurry above was added 1,085 grams of SX-5 lubricating oil, 156 grams (1.2 moles) 2-ethylhexanol, 189.6 grams (1.0 moles) n-decanol, and 162 grams (0.6 moles) of n-octadecanol. The mixture was stirred and heated to a temperature of about 350° F. to remove benzene. The reaction mixture changed from a slurry to a clear solution. Eight grams dodecylbenzene sulfonic acid esterification catalyst was added to the reaction mixture, and water of esterification was generated. The reaction was continued for about 7 hours during which water of esterification was removed. At the end of the reaction, about 18 milliliters of water were recovered. At both 2.5 hours and 4.5 hours during the esterification reaction, an additional 8.0 grams of dodecylbenzene sulfonic acid was added. After 7.0 hours of reaction, the product was stripped of excess alcohol and other volatiles at 400° F. (204° C.) and at reduced pressure.

Transesterification

To the stripped esterified styrene-maleic anhydride copolymer above was added a solution consisting of 3.0 g of metallic sodium, dissolved in 153 grams or 180 milliliters (1.04 mole) of 2-dibutylaminoethanol. The mixture was allowed to react at a temperature about 400°–420° F. (204°–215° C.) for about 1 hour. At the end of the reaction the product was stripped of volatile material at 400° F., cooled, and was stored.

EXAMPLE II

Styrene-Maleic Anhydride Polymerization

The polymerization of Example I was repeated with 800 ml of benzene 49 gm (0.5 mole) of maleic anhydride, 52 gm (0.56 mole) styrene and 0.5 gm (0.002 mole) benzoyl peroxide.

Esterification

To the styrene-maleic anhydride copolymer slurry was added 540 gm SX-5 oil, and 54 gm (0.2 mole) n-octadecanol. The mixture was stirred and stripped of benzene and stabilized at 170° F. (77° C.) for 2 hours. To the stabilized mixture was added 125 gm (0.96 mole) 2-ethylhexanol, 94.8 gm (0.5 mole) n-decanol, and 8.5 gm $C_{15}$ alkyl benzene sulfonic acid esterification catalyst. The mixture was allowed to react and water of esterification was collected. Additional 8.5 gm amounts of sulfonic acid was added at 2.5 hours and at 4.5 hours from the beginning of the reaction, and additional water of esterification was removed. After 7.0 hours of reaction, 5.5 gms (0.04 mole) of 2-ethylhexylamine was added, and the mixture was stirred for 10 minutes.

Transesterification

To the resulting mixture was added 90 ml of the sodium salt of dibutylaminoethanol prepared by reacting 250 ml or 213 gm (1.44 mole) of dibutylaminoethanol and 4.17 gm (0.18 mole) of metallic sodium at 150° F. (60° C.). The resulting mixture was stirred and heated to 400° F. (204° C.) for 1 hour and was stripped and stored.

EXAMPLE III

Styrene-Maleic Anhydride Polymerization

In a three-neck flask equipped with a stirrer, heater, nitrogen atmosphere and dropping funnel were mixed 1,600 milliliters of benzene, and 98 grams (1.0 mole) of maleic anhydride. The mixture was stirred and heated to a temperature of 160° F. (72° C.) under a nitrogen atmosphere for about 15 minutes. To the stirred and heated mixture maintained at 165° F. was added 1.0 grams (0.004 moles) benzoyl peroxide and 34.0 grams (0.33 moles) of styrene. After this addition an additional 70 grams (0.67 mole) of styrene were added dropwise to the solution from a dropping funnel over a one-hour period. The reaction mixture was maintained at 160° F. (72° C.) for about 6 hours. During this time a slurry of copolymer in benzene was formed.

Esterification

To the styrene-maleic anhydride copolymer slurry above was added 1,085 grams of SX-5 lubricating oil, 156 grams (1.2 moles) 2-ethylhexanol, 189.6 grams (1.00 moles) n-decanol, and 162 grams (0.60 moles) of n-octadecanol. The mixture was stirred and heated to a temperature of about 350° F. to remove benzene, and the reaction mixture changed from a slurry to a clear solution. The solution was heated to 400° F. (204° C.) and 8 grams dodecylbenzene sulfonic acid esterification catalyst was added to the reaction mixture, and water of esterification was immediately generated. The reaction was continued for about 7.5 hours during which a total of 18.0 ml of water of esterification was removed. At about 2.5 hours and 4.5 hours during the esterification reaction, an additional 8.0 gms of dodecylbenzene sulfonic acid was added. After 7.0 hours of reaction, the product was stripped of excess alcohol and other volatiles at 400° F. (204° C.) and at reduced pressure.

Transesterification

To the stripped esterified styrene-maleic anhydride copolymer above was added a solution consisting of 3 grams metallic sodium, dissolved and 136 milliliters 145.6 gms (1.1 mole) of beta-hydroxyethyl morpholine. The mixture was allowed to react at a temperature about 400°–420° F. (204°–215° C.) for about 1 hour. At the end of the reaction the product was stripped of volatile material at 400° F., cooled, diluted with 116 gm SX-5 oil and was stored.

EXAMPLE IV

Styrene-Maleic Anhydride Polymerization

In a three-neck flask equipped with a stirrer, heater, nitrogen atmosphere and dropping funnel were mixed 800 milliliters of benzene, and 49 grams (0.5 mole) of maleic anhydride. The mixture was stirred and heated to a temperature of 158° F. (70° C.) under a nitrogen atmosphere for about 15 minutes. To the stirred and heated mixture maintained at 158° F. (70° C.) was added 0.5 grams (0.002 moles) benzoyl peroxide and 17.32 grams (0.165 moles) of styrene. After this addition an additional 34.68 grams (0.335 mole) of styrene were added dropwise to the solution from a dropping funnel over a one-hour period. The reaction mixture was maintained at 158° F. (70° C.) for about 6 hours. During this time the slurry of copolymer in benzene formed. The benzene was removed by a stream of nitrogen at 338° F. (170° C.)

Esterification

To the styrene-maleic anhydride copolymer slurry above was added 125 grams (0.96 mole) 2-ethylhexanol and 94.8 grams (0.5 mole) n-decanol. Twelve grams dodecylbenzene sulfonic acid esterification catalyst was added to the reaction mixture, and water of esterification was immediately generated. The reaction was continued for about 2 hours during which a total of 9 grams water of esterification was removed. At this point 5.5 grams (0.04 mole) of 2-ethylhexylamine was added and was permitted to react at 400° F. for 15 minutes.

Transesterification

To the esterified styrene-maleic anhydride copolymer above was added 5.5 grams (0.042 mole) of 2-ethylhexyl amine and 19.8 grams of dimethylaminoethanol sodium salt prepared by reacting 0.95 grams (0.004 mole) metallic sodium and 25 grams (0.28 mole) dimethylaminoethanol. The mixture was allowed to react at a temperature about 383° F. (170° C.) for about 1 hour. At the end of the reaction the product was stripped of volatile material at 400° F., cooled, diluted with 116 gm SX-5 oil and was stored.

EXAMPLE V

Example II was repeated except with 45 ml of the sodium salt of dibutylaminoethanol instead of the 90 ml.

EXAMPLE VI

Example II was repeated except with 60 ml of the sodium salt of dibutylaminoethanol instead of the 90 ml.

The above products were tested for performance in crankcase lubricants in the Hot Tube Test, the Oxidative Thickening Test, the Shear Stability Test and the VD Engine Test. The test results appear with tables of data which follow the descriptions of the test procedures.

The Oxidation Thickening Test measures the tendency of lubricating oils to thicken under high temperature, load and under oxidizing conditions. In the test 95 grams of test oil is placed in an open oxidative tube with 5 wt% VC drain oil as a catalyst. The sample at 340° C. is blown with air at 60 cc/min. to oxidize the oil. Samples are taken periodically and the viscosity and dispersancy of the samples are measured to see the effect of oxidation.

The Hot Tube Test measures the ability of additives to provide dispersancy and detergency to the oil preventing deposits in the ring belt area of the engine. In the test oil and air or air and $NO_2$ is passed through a 2 mm capillary tube heated in an alumina block. The oil is consumed and the deposit preventing ability of the additive is measured by observing the amount of color in the deposits. 0=a heavy black opaque deposit; 10=clear and clean; 6 is the minimum passing rating.

Shear stability is measured by ASTM D3945-80.

The VD Engine Test is a standard test accepted by the American Society of Testing Materials, the American Petroleum Institute, and the Society of Automotive Engineers. The test uses a 2.3 liter Ford OHC four-cylinder engine at low to mid-range speeds and low to mid-range oil temperatures. The method simulates stop-and-go city driving and moderate freeway driving. The test duration is 192 hours and is run on unleaded gasoline. The oil characteristics which are evaluated include sludge deposits, varnish deposits, oil ring clogging, oil screen plugging, and cam wear.

TABLE I

Bench Tests Data with the Styrene/Maleic Anhydride Derivative

| | Oil A | Oil B |
|---|---|---|
| Hot Tube Test: | | |
| Air | 6 | 7 |
| $NO_x$ | 7 | 5 |
| Shear Stability Index: | 63 | 50 |
| Oxidative Thickening Test: | | |
| % Vs. Inc, 24 hrs. | 20 | 390 |
| 32 | 100 | TV |
| 40 | 160 | TV |
| 48 | 280 | TV |
| % Disp., 24 hrs. | 71 | 83 |
| 32 | 72 | 70* |
| 40 | 65 | 54* |
| 48 | 63* | 43* |
| | Oil A (wt %) | Oil B (wt %) |
| Test Lubricant | | |
| Mannich Disp. | 2.0 | 2.0 |
| Zinc dialkyl dithiophosphate | 1.5 | 1.5 |
| Magnesium sulfonate | 0.9 | 0.9 |
| Calcium sulfonized phenate | 0.7 | 0.7 |
| Example I | 7.5 | — |
| Commercial SYR/MAN-ester** | — | 9.2 |
| SX-5 | 22.0 | 21.1 |
| SX-10 | 65.4 | 64.6 |
| Vis 240° F., SUS | 85.6 | 77.8 |
| Vis 240° F., CS | 16.9 | 15. |

TV: Too viscous to measure
*: Did not disperse well
**ester prepared with polyamine nitrogen compound similar to a product in U.S. Pat. Nos. 3,933,761; 3,959,159; and 3,956,149.

TABLE II

Engine Test Results VD

| | Found | Target |
|---|---|---|
| Overall sludge | 9.72 | 9.4 |
| Overall Varnish | 7.14 | 6.8 |
| Piston Varnish | 7.22 | 7.0 |
| Cam Wear | $0.9 \times 10^{-3}$ max. | |
| | $0.7 \times 10^{-3}$ aver. | $1.0 \times 10^{-3}$ |

An examination of Tables I and II shows that applicant's additive is superior to a commercial dispersant viscosity index improver prepared from a styrene maleic anhydride, aliphatic alcohol and a polyamine. The viscosity of the oil with applicant's additive remains acceptable in terms of viscosity which the comparison additive becomes rapidly too viscous to use. Applicant's additive is also more resistant to loss of dispersancy.

While this invention is described above with a number of specific embodiments. Many variations and modifications can be made without departing from the spirit and scope of the invention as particularly set forth in the appended claims.

I claim:

1. A dispersant viscosity index improving additive composition, resistant to oxidative thickening and loss of dispersancy, which composition comprises the reaction product of a styrene-maleic anhydride copolymer, an aliphatic alcohol having at least 6 carbon atoms and a tertiary amino alkanol, said composition having been prepared by substantially esterifying said copolymer with said aliphatic alcohol to produce a substantially-esterified copolymer and subsequently transesterifying said substantially-esterified copolymer with said tertiary amino alkanol.

2. The composition of claim 1 wherein the aliphatic alcohol comprises a $C_{6-20}$ aliphatic alcohol or a mixture thereof.

3. The composition of claim 1 wherein the aliphatic alcohol comprises a $C_{8-18}$ aliphatic alcohol or a mixture thereof.

4. The composition of claim 1 wherein the tertiary amino alkanol comprises a compound of the formula

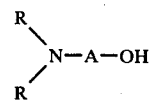

wherein A is an alkylene group having 2 to 20 carbon atoms and each R is independently selected from the group consisting of alkyl groups having 1 to 20 carbon atoms.

5. The composition of claim 4 wherein the tertiary amino alkanol comprises dialkylaminoethanol.

6. The composition of claim 5 wherein the dialkyl amino ethanol comprises dibutylaminoethanol.

7. The composition of claim 5 wherein the dialkyl amino ethanol comprises dimethylaminoethanol.

8. The composition of claim 1 wherein the tertiary amino alkanol comprises a N-hydroxyalkyl heterocyclic tertiary amine compound.

9. The composition of claim 8 wherein the N-hydroxyalkyl heterocyclic tertiary amine compound comprises a 4-(hydroxyalkyl)morpholine.

10. A process for the preparation of a dispersant viscosity index improving lubricating oil additive, which process comprises reacting a styrene-maleic anhydride copolymer with an aliphatic alcohol having at least 6 carbon atoms until the styrene-maleic anhydride copolymer is substantially esterified and reacting the substantially esterified copolymer with a tertiary amino alkanol.

11. A lubricant comprising a major portion of a lubricating oil and an effective dispersancy and viscosity index improvement providing amount of the additive composition of claim 1.

12. A gasoline comprising a major portion of a hydrocarbon fuel boiling in the gasoline range and an effective deposit preventing amount of the composition of claim 1.

* * * * *